US007272904B2

(12) United States Patent
Larue

(10) Patent No.: US 7,272,904 B2
(45) Date of Patent: Sep. 25, 2007

(54) ADJUSTABLE THROW-LEVER PICATINNY RAIL CLAMP

(76) Inventor: Mark C. Larue, 850 County Rd. 177, Leander, TX (US) 78641

( * ) Notice: Subject to any disclaimer, the term of this patent is extended or adjusted under 35 U.S.C. 154(b) by 420 days.

(21) Appl. No.: 11/008,394

(22) Filed: Dec. 9, 2004

(65) Prior Publication Data

US 2006/0123686 A1 Jun. 15, 2006

(51) Int. Cl.
*F41G 1/38* (2006.01)

(52) U.S. Cl. ..... 42/127; 42/124; 42/125; 292/43; 292/145; 292/155; 292/176

(58) Field of Classification Search ..... 42/111–148; 292/43, 145, 155, 176
See application file for complete search history.

(56) References Cited

U.S. PATENT DOCUMENTS 2,810,963 A * 10/1957 Harper ..... 42/127
4,620,372 A * 11/1986 Goodrich ..... 33/265
4,835,895 A * 6/1989 Bowen ..... 42/127
4,845,871 A * 7/1989 Swan ..... 42/127
5,155,915 A * 10/1992 Repa ..... 42/127
5,276,988 A * 1/1994 Swan ..... 42/127
5,375,361 A * 12/1994 Rustick ..... 42/125
5,383,278 A * 1/1995 Kay ..... 33/265
5,680,725 A * 10/1997 Bell ..... 42/127
7,107,716 B1 * 9/2006 Liao ..... 42/108
2006/0283070 A1 * 12/2006 Murello ..... 42/127

* cited by examiner

*Primary Examiner*—Lynda Jasmin
*Assistant Examiner*—Jamie Kucab
(74) *Attorney, Agent, or Firm*—James L. Jackson

(57) ABSTRACT

A throw-lever releasable mounting system for mounting a device in quick-release relation to a support member has a mounting base having a configuration fitting opposed angulated rail surfaces and having a locator key engaging a positioning slot of the rail. Each mounting base provides for mounting and stabilization of optics mounting rings. A locking platform projects from the mounting base and defines a locking opening having a circular hard metal insert therein that defines a receptacle receiving a resilient member and providing for location of the spline/spindle shaft of a rotatable locking plate. A locking plate of a throw-lever that is rotatable between locking and unlocking positions has angulated and curved cam surfaces for forcibly engaging correspondingly angulated surfaces of the rail to achieve cam energized precision locating and locking engagement with the rail. A non-circular section of a spline/spindle shaft of the throw-lever is receives a drive member in non-rotatable and linearly moveable relation. Resilient members are interposed between the drive member and the hardened insert and prevent free throw-lever movement at the release position thereof.

21 Claims, 16 Drawing Sheets

ADJUSTABLE THROW-LEVER PICATINNY RAIL CLAMP

BACKGROUND OF THE INVENTION

1. Field of the Invention

The present invention relates generally to quick-release mounting devices for releasably mounting various devices on a support structure. The present invention also relates to firearms and more particularly to releasable sighting or aiming devices for rifles. More particularly, the present invention concerns mounting devices having adjustable locking mechanisms and mounting rings for releasably securing aiming devices, such as the sighting telescopes of rifles and similar firearms and for maintaining optimum sighting accuracy even when the firearm is subjected to repeated heavy recoil when firing high velocity, large bore ammunition. Even more particularly, the present invention concerns locking type mounting rings that enable rifle sighting devices to be simply and efficiently removable and replaceable under field conditions while maintaining a preset zero when replaced.

2. Description of the Prior Art

U.S. Pat. No. 4,845,871 of Swan discloses a means for attaching first and second Weaver interface platforms of an optical rifle sight mount using throw-lever actuated locking mechanisms. The throw-lever of Swan is not adjustable, though the patent makes incorrect assumptions of its adjustability. A subsequently developed throw-lever actuated releasable optical sight mount system is set forth in U.S. Pat. No. 5,276,988 of Swan, which compensates for the inability of the throw lever to accomplish repeatability of precision positioning over extended periods of repeated firing of tactical rifles. This later patent of Swan discloses a throw-lever actuating mechanism of similar nature as set forth in U.S. Pat. No. 4,845,871, with the exception that the optical sight mount incorporates a buffer element in the form of a shim between the attachment device camming surface and the area to which the attachment device is affixed. U.S. Pat. No. 6,026,580 of Mark C. LaRue, the inventor of the present invention, discloses a self-centering and self-aligning optical sight mounting system, including front and rear mounting ring assemblies and mounting bases for mounting an optical sighting device on a firearm such as a rifle or on other devices.

SUMMARY OF THE INVENTION

It is a primary feature of the present invention to provide novel mounting rings for retaining sighting devices, such as telescopes, low light optical devices, mechanical sighting devices on firearms such as rifles and to permit removal and replacement of the sighting devices, even under field conditions, without losing the preset zero of the sighting device;

It is another feature of the present invention to provide a novel optical sight mounting system which permits one or several daylight, night or close combat optical sighting devices to be selectively interchanged on a firearm in a manner that maintains the preset sighting zero of each of the optical sighting devices with respect to the firearm that is involved; and It is also a feature of the present invention to provide a novel optical sight mounting system that employs self-centering and self-aligning optical sight mounting rings that eliminates the need for lapping for achieving a close fit with the tube of an optical sighting device and prevents damage to an optical sighting device by tube distortion from clamping force.

Though the present invention is discussed herein particularly with its application to adjustable quick-release mounting devices for firearm optical sighting devices, it should be borne in mind that it is not intended to limit the spirit and scope of the present invention solely to use in conjunction with firearms. The present invention clearly has a wide range of application in circumstances where a device is intended to be releasably mounted in stable fashion to a supporting structure. For example, the present invention has application to camera and spotting scope mounts that are used in connection with various sporting events and commercial activities. Many other uses of the present invention will become obvious to one skilled in the art upon acquiring a thorough understanding of the present invention.

Briefly, the various objects and features of the present invention are realized by a sighting device mounting system that is designed particularly for mounting to Picatinny rails, Weaver rails or other similar mounting base rail systems. Front and rear, substantially identical throw-lever actuated mounting ring assemblies are provided, each having a base structure having a portion thereof configured for fitting opposed angulated rail surfaces and having a locator element that is received within one of the multiple positioning slots of the rail. The base structures each receive a self-centering and self-aligning tube mounting ring for retaining the tube of an optical sighting device or engaging a circular portion of any supported device.

The base structures are each provided with integral laterally projecting lock supports, each defining a receptacle receiving the spline/spindle shaft of a rotatable locking plate. The rotatable locking plate has angulated cam surfaces merging with a central curved cam surface for forcibly engaging correspondingly angulated rail surfaces to achieve cam energized locking engagement with the angulated rail surfaces. Throw-levers project from each of the rotatable locking plates to provide for manual rotation of the rotatable locking plates during locking and unlocking. At least a portion of the spline/spindle shaft is of non-circular, typically hexagonal cross-sectional configuration and receives a generally circular drive washer member having a central opening of corresponding non-circular configuration so as to have non-rotatable and linearly moveable relation with the spline/spindle shaft. To provide a light weight optical sight mount for firearms, the mounting base and the support rings of the sight mounting system are preferably composed of a light-weight material such an aluminum alloy, hard polymer material or the like. The mounting base is drilled or otherwise formed to eliminate material and reduce the weight thereof. Since the light weight material are often quite soft and easily yielded by application of forces, hardened metal inserts composed of stainless steel, steel or other suitable hard materials are press-fitted or otherwise seated in appropriate openings or receptacles of the mount structure. These inserts are typically threaded so as to have threaded engagement with retainer elements such as Torx or Allen screws.

BRIEF DESCRIPTION OF THE DRAWINGS

So that the manner in which the above recited features, advantages and objects of the present invention are attained and can be understood in detail, a more particular description of the invention, briefly summarized above, may be had by reference to the preferred embodiment thereof which is illustrated in the appended drawings, which drawings are incorporated as a part hereof.

It is to be noted however, that the appended drawings illustrate only a typical embodiment of this invention and are therefore not to be considered limiting of its scope, for the invention may admit to other equally effective embodiments.

In the Drawings:

FIG. 1 is a pictorial representation showing a sight mounting rail on a firearm and showing releasable, adjustable optical sight mounting rings embodying the principles of the present invention and being in locked assembly with the sight mounting rail and mounting an optical sighting device;

FIG. 2 is a pictorial representation of one of the optical sight mounting ring assemblies of FIG. 1 showing one side of the releasable and adjustable mounting ring assembly of the present invention:

FIG. 3 is a pictorial representation showing the opposite side of the releasable and adjustable mounting ring assembly shown in FIG. 2 and showing the lever actuated locking mechanism in the locked position thereof;

FIG. 4 is a plan view of the releasable and adjustable mounting ring assembly of FIGS. 1-3 and showing the locking lever thereof in its release position and with a wave spring providing an urging force on the locking lever assembly;

FIG. 5 is an isometric illustration of the releasable and adjustable mounting ring assembly of the present invention, again with the locking lever being shown in the release position thereof;

FIG. 6 is a sectional view of the releasable and adjustable mounting ring assembly taken along line 6-6 in FIG. 4, with the locking lever being shown in the release position thereof;

FIG. 7 is a partial sectional view of the releasable and adjustable mounting ring assembly of the present invention and with the locking lever being shown in the release position thereof;

FIG. 8 is an isometric illustration of a drive nut component of the locking lever assembly and showing a downwardly facing annular spring recess for receiving a wave spring or one or more O-ring type locking lever resistance members;

FIG. 9 is a bottom view of the drive nut component of FIG. 8;

FIG. 10 is a side elevational view showing a wave spring that is received by the downwardly facing annular spring recess of the drive nut member of FIG. 8;

FIG. 11 is a sectional view of the drive nut member of FIGS. 8 and 9;

Figure 12:
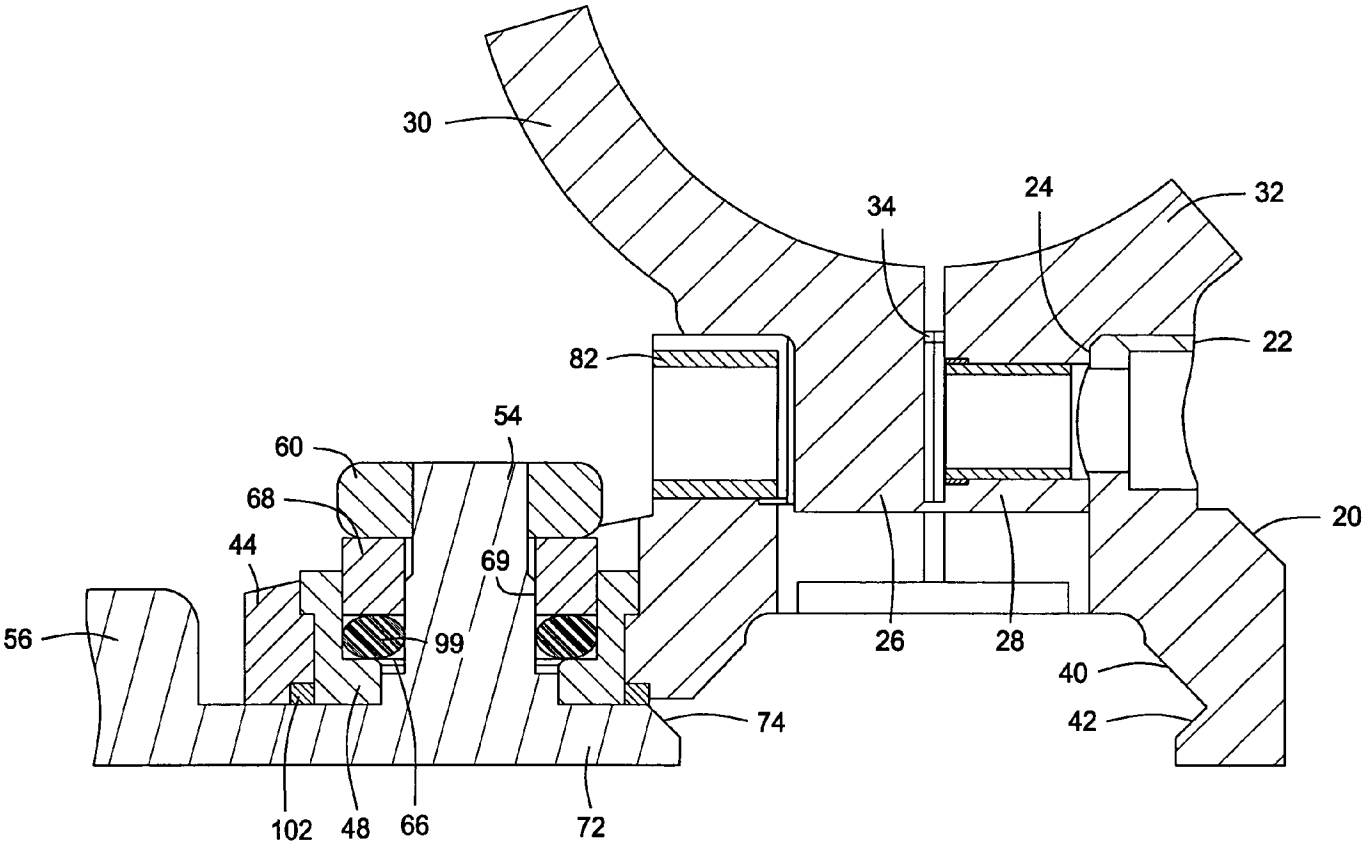

FIG. 12 is a partial sectional view of an alternative embodiment of the releasable and adjustable mounting ring assembly of the present invention, showing the use of resilient O-ring members which retard inadvertent throw-lever movement at the unlocked position of the adjustable mounting ring assembly.

Figure 1:
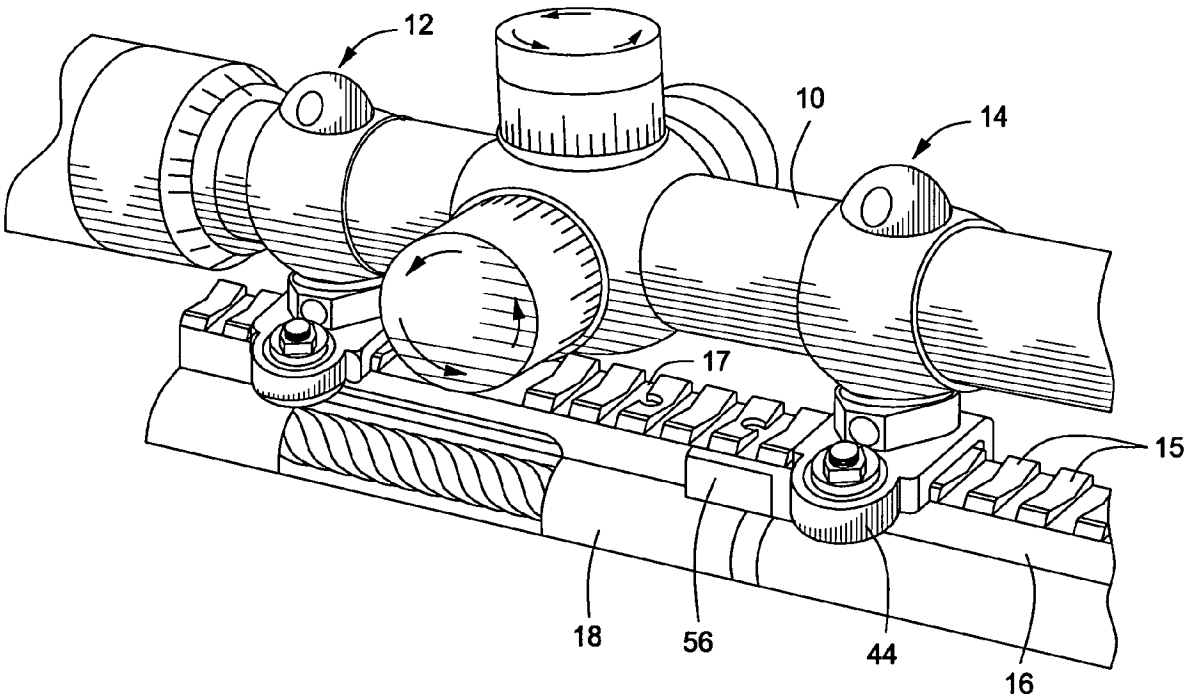
Figure 3:
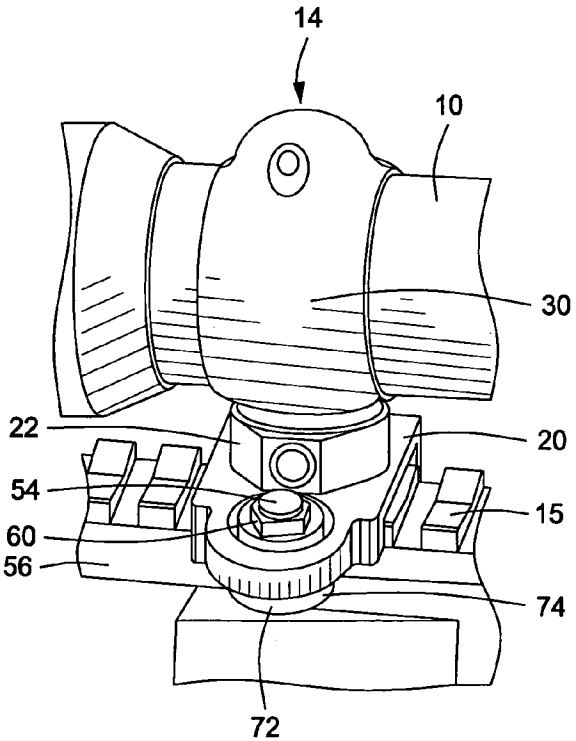
Figure 2:
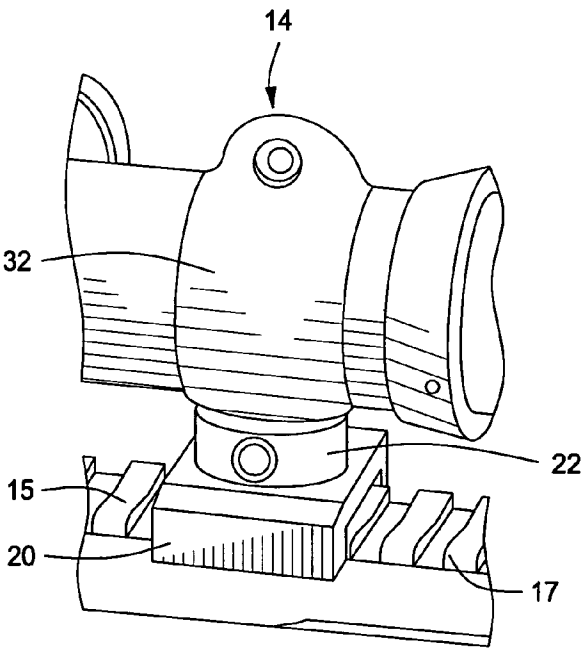
Figure 4:
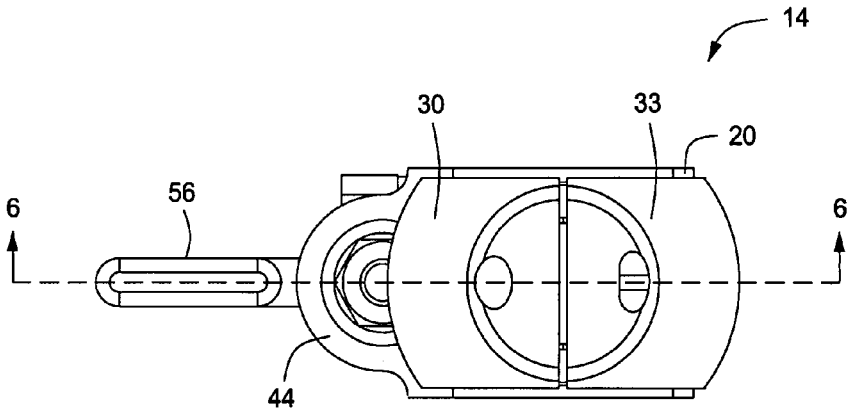
Figure 13:
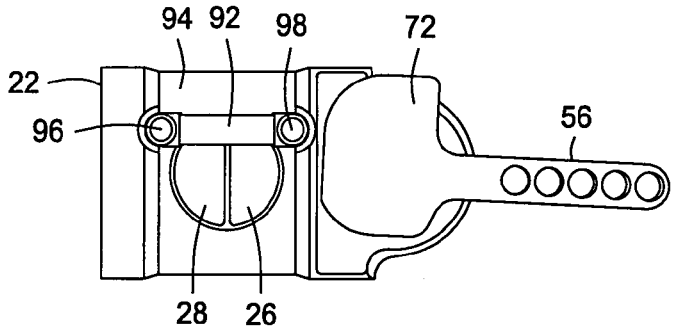
Figure 14:
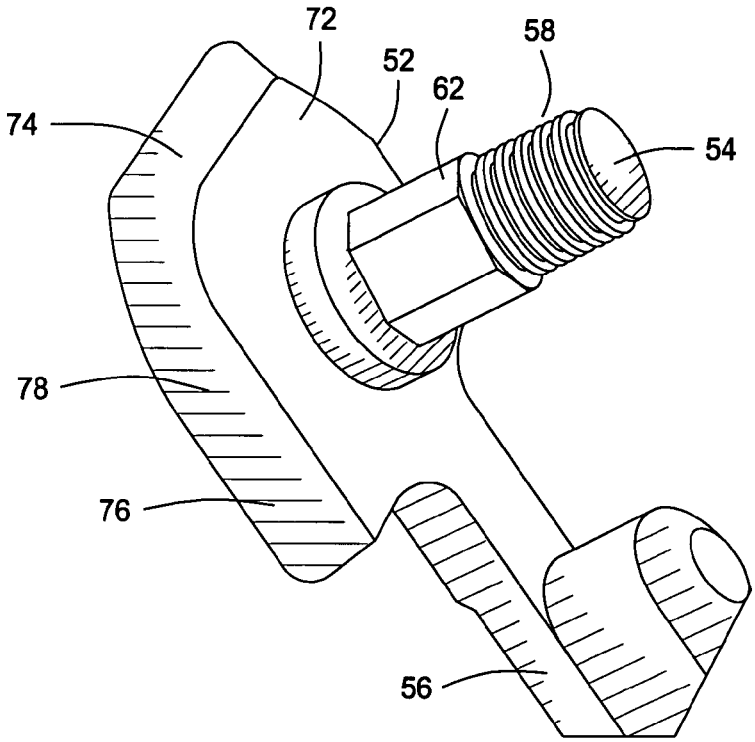
Figure 15:
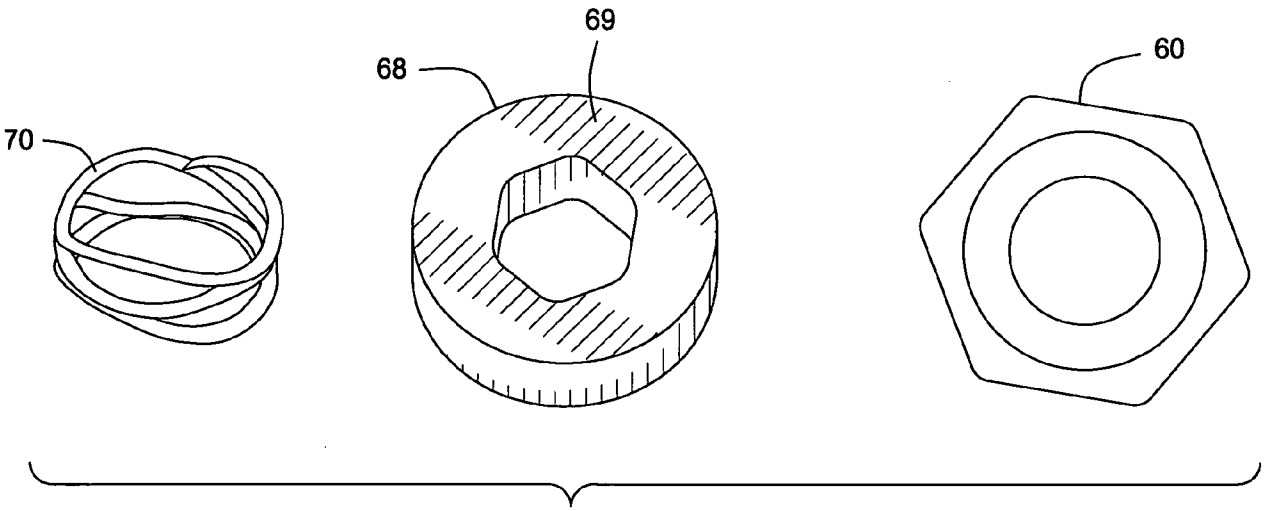
Figure 16:
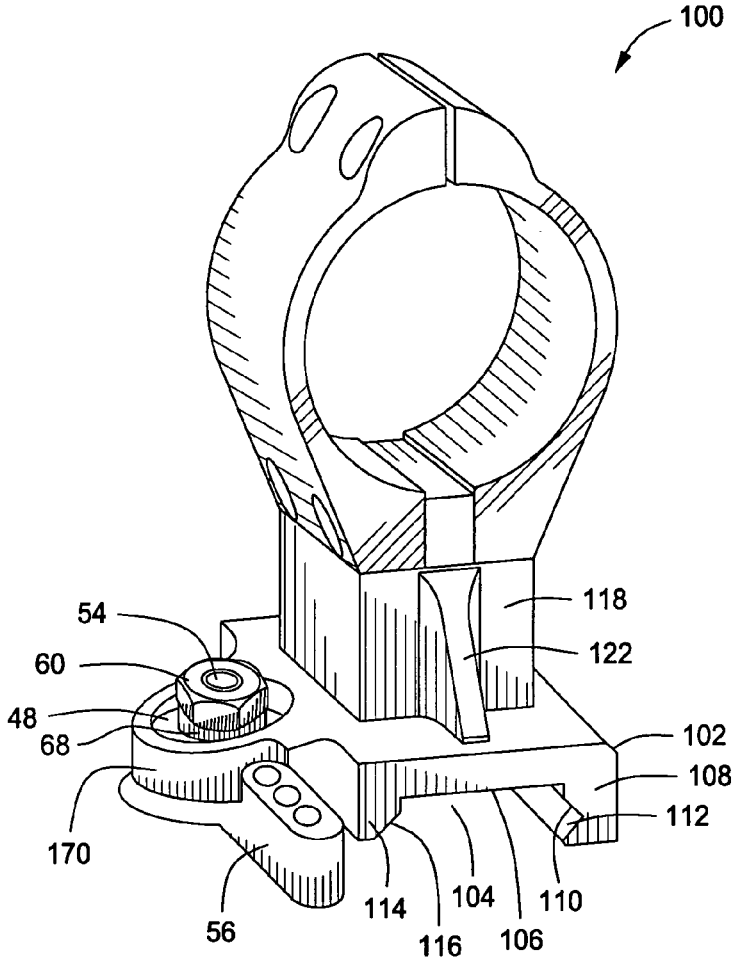
Figure 17:
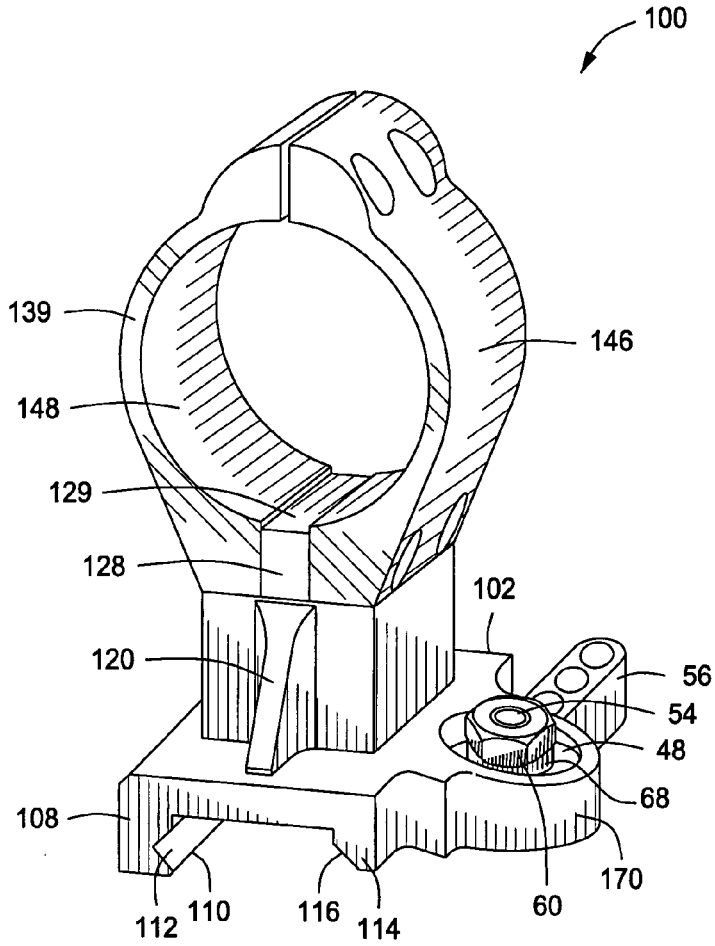
Figure 18:
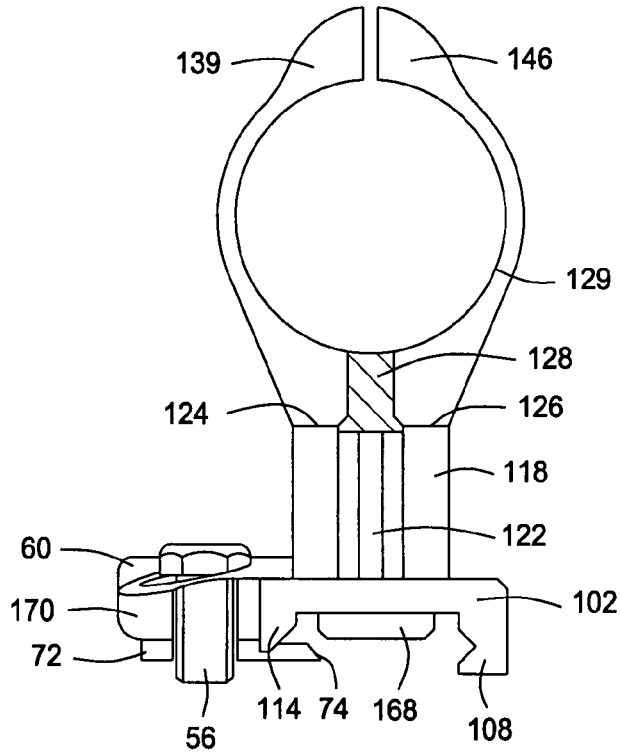
Figure 19:
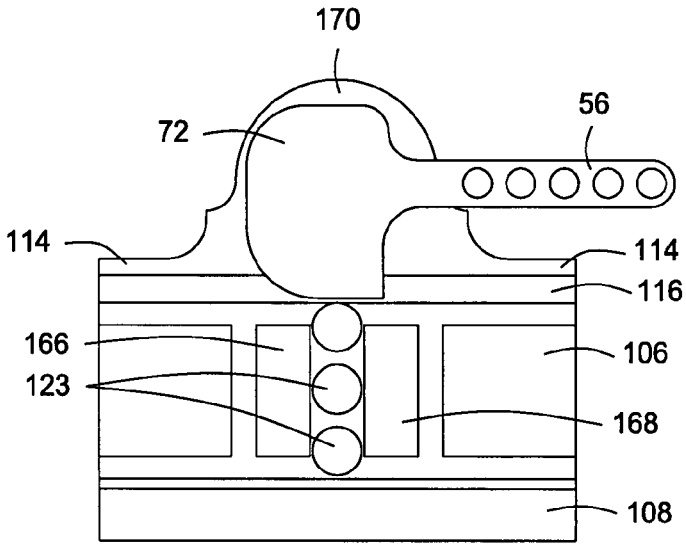
Figure 20:
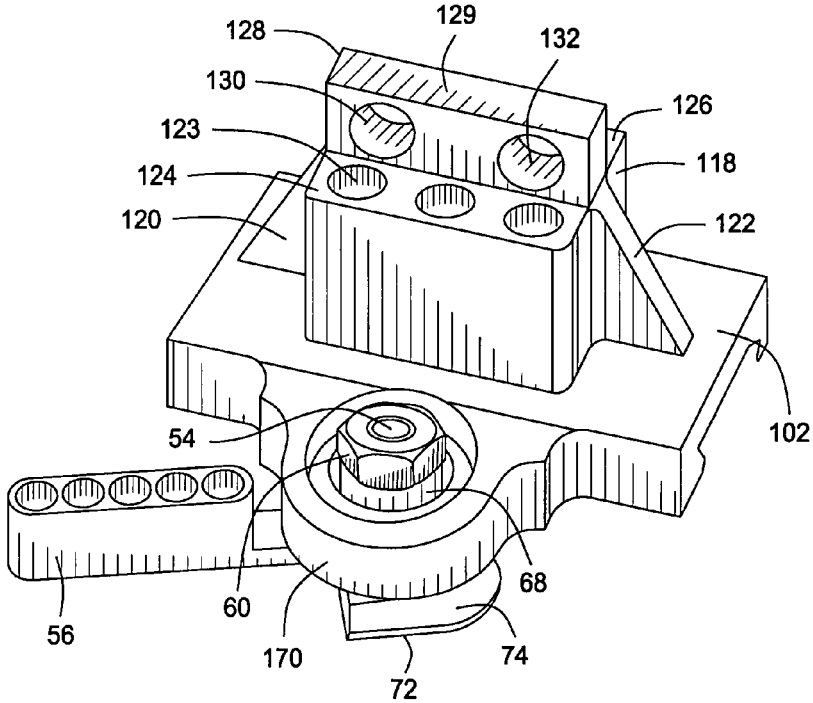
Figure 21:
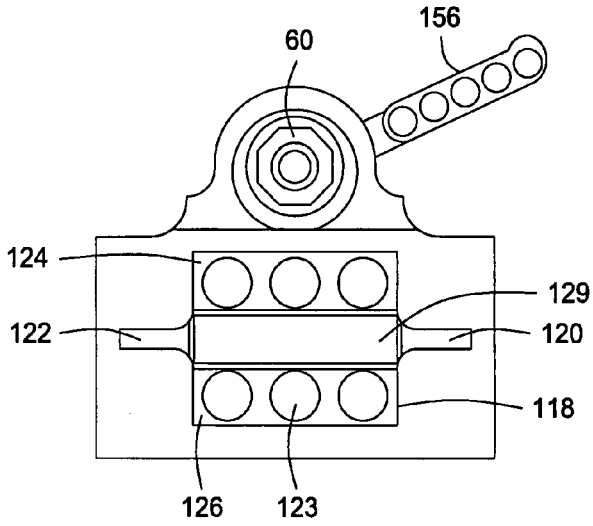
Figure 22:
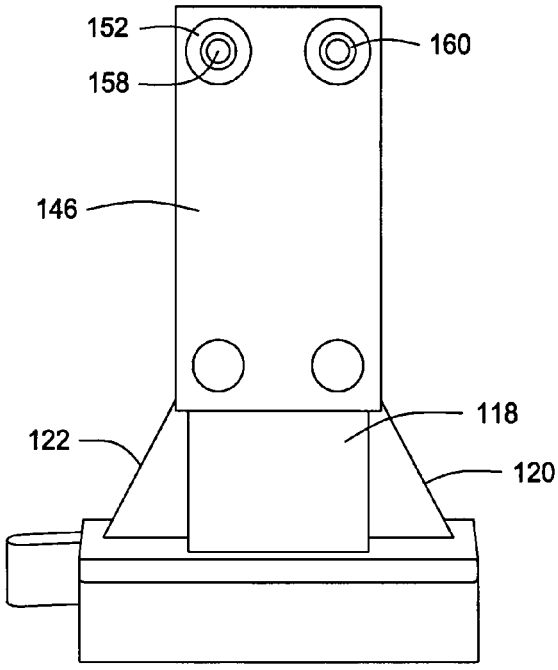
Figure 23:
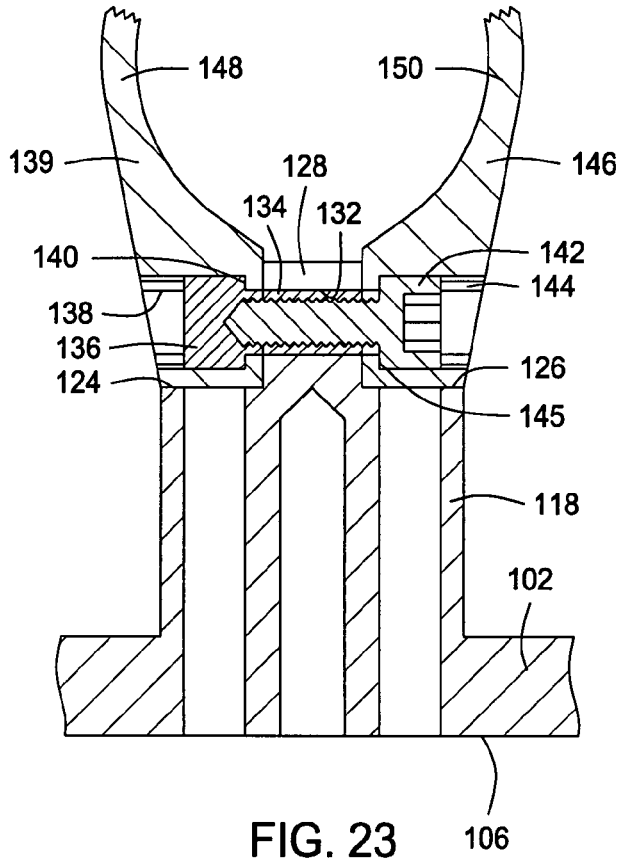
Figure 24:
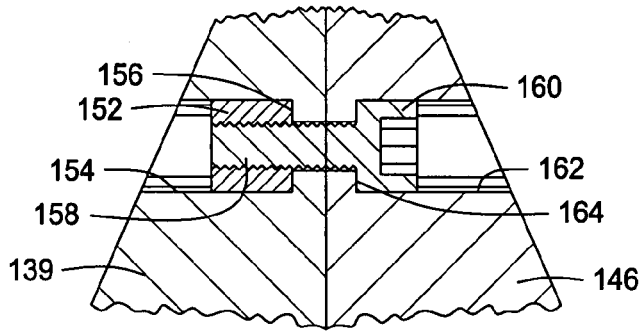

FIG. 13 is a bottom view of the releasable and adjustable mounting ring assembly of the present invention showing the bottom of the locking lever and showing the offset position of a rail slot engaging sight locator key element with respect to the pivot point of the locking lever;

FIG. 14 is a partial isometric illustration of the locking lever, showing the non-circular configuration of the lever spline/spindle post and showing the threaded terminal end of the lever pivot shaft or post;

FIG. 15 is an isometric illustration showing the disassembled components of the adjustment assembly of the adjustment mechanism of the locking lever and showing the wave spring and the non-circular opening that is defined by a spring urged drive washer member of the locking lever adjustment mechanism;

FIG. 16 is an isometric illustration showing a preferred embodiment of the present invention comprising a releasable, adjustable optical sight mounting ring assembly having a locking lever assembly of the nature shown in FIG. 1;

FIG. 17 is another isometric illustration showing the releasable, adjustable optical sight mounting ring assembly of FIG. 16;

FIG. 18 is a front elevational view of the releasable, adjustable optical sight mounting ring assembly of FIGS. 16 and 17;

FIG. 19 is a bottom view of the releasable, adjustable optical sight mounting ring assembly of FIGS. 16-18;

FIG. 20 is an isometric illustration showing the releasable, adjustable optical sight mounting ring assembly, with the sighting device mounting elements removed and showing the detailed structure of the mounting base;

FIG. 21 is a plan view of the mounting base structure of FIG. 20;

FIG. 22 is a elevational view showing the opposite side of the releasable, adjustable optical sight mounting ring assembly as compared with the views of FIGS. 16 and 17;

FIG. 23 is a partial transverse sectional view taken along line 23-23 of FIG. 22; and FIG. 24 is a partial transverse sectional view taken along line 24-24 of FIG. 22.

DETAILED DESCRIPTION OF PREFERRED EMBODIMENT

Though the present invention is discussed herein particularly as it relates to releasable mounts for firearms, particularly tactical rifles used by military and law enforcement personnel, it is to be understood that this invention has application for support of devices other than optical sighting devices on other objects. Referring now to the drawings and first to FIG. 1, an optical sighting device 10, such as a sighting telescope, is supported by front and rear mounting ring assemblies, shown generally at 12 and 14, that mount the sighting device on a mounting rail 16, such as a Picatinny rail or a Weaver rail or the like which is affixed to a firearm 18 or other object. The rail 16 defines a number of evenly spaced upwardly extending mounting projections 15 with evenly spaced transverse slots 17 therebetween to provide for selective location of an optical device on the firearm. As is evident in FIG. 7, each of the spaced upwardly extending mounting projections defines undercut parallel, oppositely angulated clamping surfaces 19 and 21 and oppositely angulated, typically upwardly facing support surfaces 23 and 25 that are disposed in angulated relation with one another. Each of the clamping surfaces 19 and 21 and the support surfaces 23 and 25 are initially formed by elongated surfaces, typically extending the length of the rail structure 16 and are interrupted by transverse slots 17 that are machined or otherwise formed in evenly spaced relation along the length of the rail.

Figure 6:
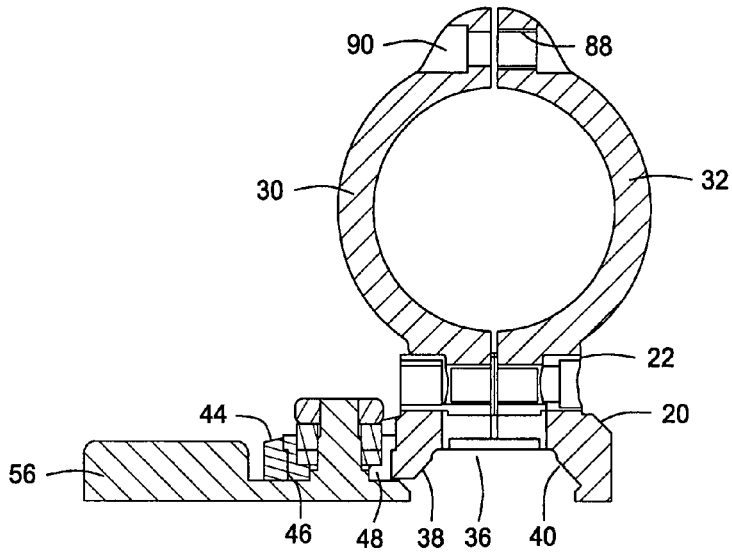
Figure 5:
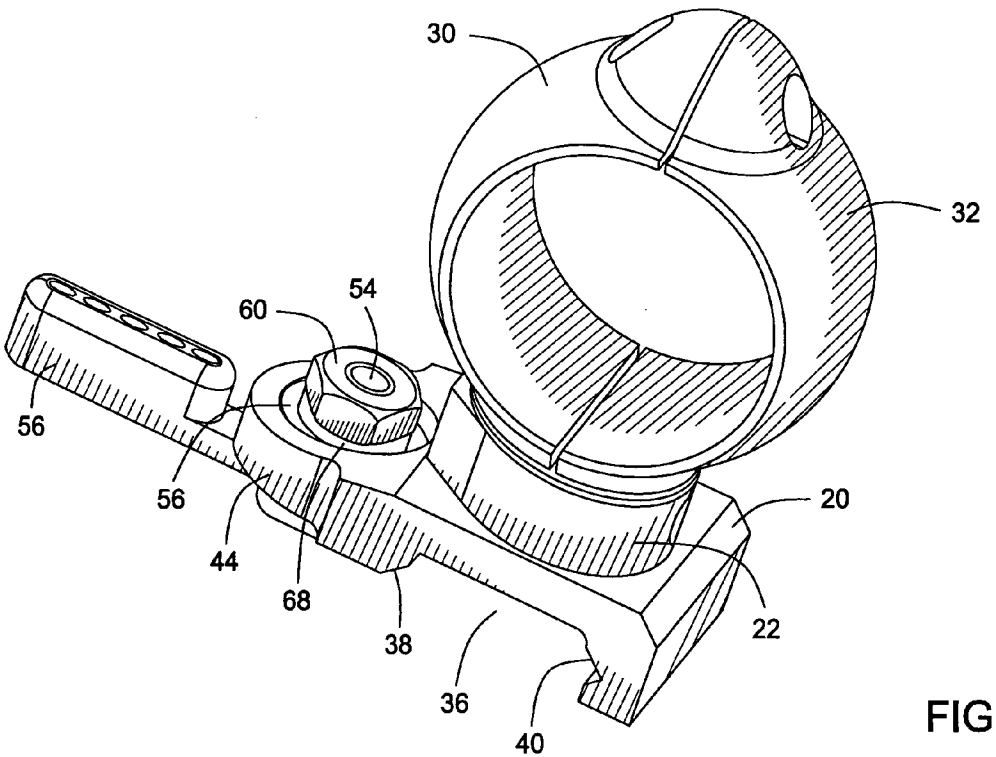
Figure 7:
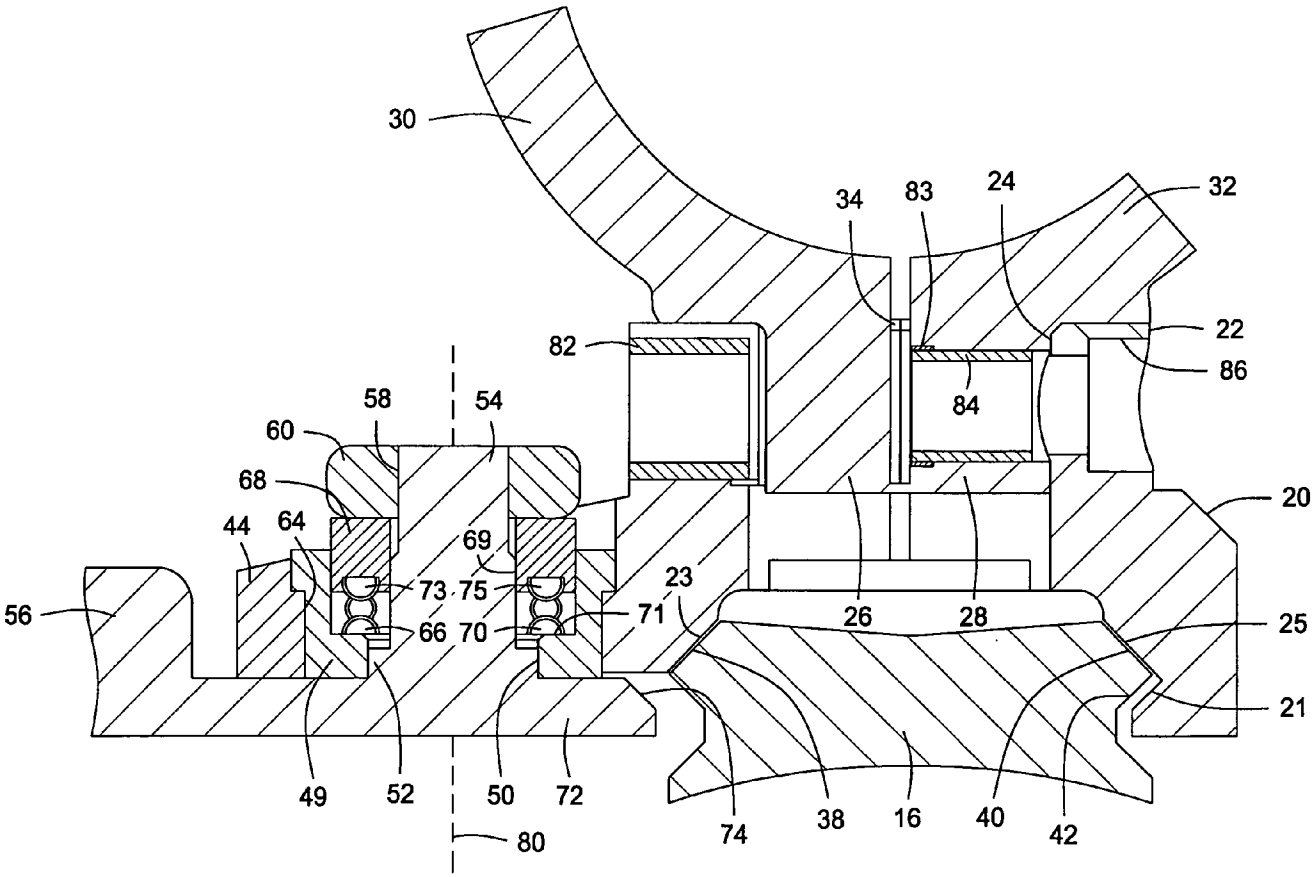

Each of the mounting ring assemblies 12 and 14 incorporates a mounting base 20 having an integral, upwardly projecting member or boss 22 that is internally machined to define a receptacle 24 within which is received the depending mounting tongue elements 26 and 28 of mounting ring sections 30 and 32. The mounting ring sections 30 and 32 are secured together by fastener members, such as Torx screws, Allen screws or the like, to establish clamping retention of the mounting ring sections 30 and 32 to a tubular housing member of a sighting device such as an optical sighting device or telescope or a laser sighting device. Where fastener members such as retainer screws and set screws are employed to secure soft metal members, such as aluminum members, in assembly, hard metal inserts, typically composed of steel, such as stainless steel, are press-fitted into drilled or bored openings in the soft metal members as shown in FIGS. 6 and 7 as well as FIGS. 23 and 24. These hard metal inserts are typically internally threaded and provide the soft metal members with exceptional resistance to wear or thread damage by hard metal retainer screws and the like. The hard metal inserts may be seated on internal support shoulders of the mounting ring sections to ensure against movement thereof by the forces that are developed when screws are tightened by screwdrivers or by Allen or Torx wrenches.

In the embodiment of FIGS. 1-15, as shown particularly in FIGS. 7 and 12, one or more shims 34 are located between the mounting tongue elements 26 and 28. The shims ensure proper spacing of the mounting ring sections 30 and 30 for optimum gripping relation with the tubular housing of the optical sighting device, without causing collapsing, excessive application of torque force or causing other damage to the tubular housing of the sighting device and the internal sighting mechanism thereof. The fastener screws of each of the mount bases are sequentially tightened to ensure even and efficiently controlled gripping of the tubular housing of the sighting device, without subjecting the tubular housing to torque forces during tightening. This feature ensures against mount tightening force deformation of tubular telescope sections and thus ensures protection of delicate internal telescope components from damage and accelerated wear.

The mounting base 20 is configured to define a rail receiving receptacle 36 with spaced, downwardly and oppositely angulated surfaces 38 and 40 which are oriented for contact with correspondingly angulated support surfaces 23 and 25 of the rail 16. The mounting base 20 also defines an upwardly angulated surface 42 that is positioned for retaining engagement with a correspondingly angulated clamping surface 21 of the rail 16.

A locking platform 44 is integral with and extends laterally from each of the mounting bases 20 and defines an opening 46 within which is seated an annular insert 48 that is composed of a suitable hard, wear and impact resistant metal material such as steel, stainless steel, titanium alloy or any suitable non-metal material having wear and impact resistance. The annular insert 48 defines a central opening 50 that receives an upwardly projecting circular shoulder 52 of a spline/spindle shaft or post 54 in rotatable relation therein. The spline/spindle shaft 54 is integral with and projects upwardly from a manually rotated cam plate of a locking lever structure 56, also referred to as a "throw-lever", as shown in FIGS. 6 and 7. The manually rotated locking lever structure 56 of each ring assembly 12 and 14 is manipulated, i.e., rotated, for locking and unlocking of the front and rear mounting bases 20 from the rail 16 when it is desired to remove and replace the optical sighting device 10. Especially when the sighting device is being used on firearms under tactical circumstances, this feature permits the sighting device to be carried in protective fashion, such as in a pocket of a personnel pack, and when its use is needed, the user will simply and quickly clamp the sighting device to the rail device 16 of the firearm, with the sighting device being accurately positioned at its pre-set sighting position or zero. This feature permits a sighting device to be unlocked, removed and re-assembled and locked in place without losing its preset aim point or zero.

The outer or terminal extremity of the spline/spindle shaft 54 is threaded as shown at 58 for receiving an adjustment nut 60. The threaded section 58 and the internal threads of the adjustment nut 60 are cut on a slightly different pitch to cause interference tightening of the nut on the threaded section 58 of the spline/spindle shaft 54 as the adjustment nut is rotated in the direction, typically clockwise, during assembly of the adjustment nut to the spline/spindle shaft 54. This feature minimizes the potential for loosening of the adjustment nut 60 after it has been selectively positioned on the spline/spindle shaft 54. However, if further tightening or loosening of the adjustment nut is needed, such as for increasing or decreasing the clamping force of the mounting base 20 on the rail 16 of a firearm, rotational movement of the adjustment nut 60 is easily accomplished through the use of a simple hex wrench. The interference tightening arrangement ensures that the adjustment nut 60 will remain in any pre-set position even when the mounting ring assembly of a sighting device is subjected to impacts, vibration or other rough treatment.

Figure 8:
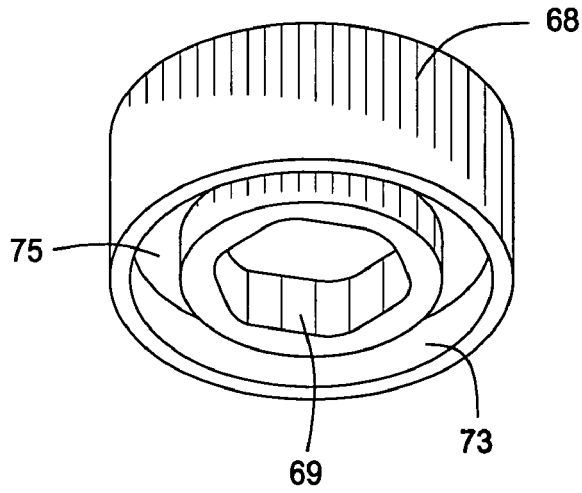

The spline/spindle shaft 54 is also provided with a shaft section 62 of non-circular cross-sectional configuration that may be hexagonal or may have any other non-circular cross-sectional configuration as desired. The shaft section 62 is also referred to herein as a "spline section", with the non-circular configuration or spline thereof extending longitudinally of the spline/spindle shaft 54 from the externally threaded section 58 to the circular shoulder 52. The spline/spindle shaft 54 and the inner cylindrical surface 64 of the annular insert 48 are of significantly different dimensions, thus defining an annular space 66 therebetween within which a drive washer member 68 and one or more resilient members are received. The resilient member or members preferably comprise a single wave spring 70, as shown in FIGS. 7 and. 15, but may comprise one or more resilient O-rings as shown in FIG. 8 or may comprise one or more washer-like springs referred to as Belleville springs or washers. Typically, however, the spring forces achieved by one or more Belleville springs used in this fashion would be quite high and might add significantly and unnecessarily to the rotational force that is required to rotate the locking lever to and from its locking position and at its unlocked condition. Also, Belleville springs minimize permissible linear movement of the drive washer member 68 as the springs are subjected to compression force by tightening the adjustment nut 60. Thus, Belleville springs are not considered preferred resilient components for the locking lever assembly. The annular insert 48 defines an upwardly facing internal shoulder surface 71 which serves to retain the lowermost portion or the lowermost one of the resilient member or members within the annular space 66. A lower portion of the drive washer member 68 extends into the annular space 66 and defines an annular downwardly facing recess 73 within which the upper portion of the wave spring 70 is located to provide for spring centering and stabilization. The wave spring is maintained under compression between the upwardly facing annular surface 71 and an annular downwardly facing recess surface 75 of the drive washer member 68 and imparts a spring force to surfaces 71 and 75 that is only great enough to provide sufficient frictional resistance that prevents free rotational movement of the locking lever 56 when the locking lever is at its unlocked position as shown in FIGS. 7 and 12. In other words, the wave spring 70, or other resilient member or members 99, prevent the locking lever from freely flopping about when it is unlocked.

Other resilient members discussed herein provide similar function. This feature is considered important to the tactical use of a firearm, especially in conditions of poor light, where the condition of the locking lever may need to be assured at any point in time, even in its unlocked condition. By minimizing the potential for locking lever movement when it is unlocked, the potential for undesired noise is minimized. This feature is quite important in tactical firearm use.

The drive washer member 68 defines a non-circular internal spline section 69 corresponding to the dimension and configuration of the non-circular external spline of the spline section 62 of the spline/spindle shaft 54. The spline section 69 may be of hexagonal configuration or any other suitable non-circular configuration having mating, non-rotational relation with the non-circular external portion of the spindle/spline shaft 54. This feature causes the drive washer member 68 to be non-rotatable and linearly moveable with respect to the spline/spindle shaft and rotatable along with the spline/spindle shaft as the locking lever 56 is manually rotated. Also, the axial length of the spline section 62 of the spline/spindle shaft 54 in comparison with the shorter axial length of the non-circular internal spline section 69 of the drive washer member 68 permits axial movement of the drive washer member by the adjustment nut 60 and the wave spring 70 for the purpose of increasing or decreasing the clamping force of the mounting base 20 with respect to the rail 16. A firearm user is capable of achieving adjustment of the clamping force simply by rotating the adjustment nut with a simple hex wrench or other readily available adjustment tool.

The locking lever 56 is provided with an integral cam plate 72 from which the spline/spindle shaft 54 projects. Edge portions of the cam plate 72 define angulated, substantially straight tapered cam surface sections 74 and 76 that merge with an intermediate substantially curved tapered cam section 78 that is located eccentrically with respect to the longitudinal axis of the spline/spindle shaft 54. Each of the tapered cam sections is inclined at an angle corresponding to the inclination and orientation of the undercut downwardly facing angulated clamping surface 19 of the rail 16. Thus, manually energized rotation of the cam plate 72 by application of manual force to the locking lever 56 causes locking or unlocking movement of the mount assembly with respect to the sight mounting rail of the firearm.

During locking rotation of the cam plate the eccentric curved cam surface will engage the undercut downwardly facing angulated clamping surface 19. As locking rotation continues, due to its eccentric orientation, the clamping force of the curved cam surface will increase as the distance of the curved cam surface from the pivot axis 80 increases until a maximum clamping force is reached at the merged juncture of the curved cam surface and the locking cam surface 76. This maximum clamping force is easily controlled by selective rotation of the adjustment nut 60 so that metal deformation of the undercut downwardly facing angulated clamping surface 19 will not occur or will be minimized within acceptable limits. Further locking rotation of the cam plate by the locking lever 56 causes the substantially straight locking cam section 76 to move into face to face relation with the angulated clamping surface 19 of the rail 16.

The cam surface sections 74, 76 and 78 of the cam plate are positioned with respect to the pivot axis 80 of the spline/spindle shaft 54 so that engagement of the cam surface sections tighten on the corresponding angulated rail surfaces as the locking lever is rotated from the unlocking position to the locking position. At the unlocking position of the locking lever 56 the unlocking surface 74 is essentially clear of the angulated clamping surface 19 of the rail 16, thus allowing lateral movement of the mounting base 20 to a position allowing separation of the mounting base from the rail structure. During locking rotation of the locking lever, the curved eccentric section 78 of the cam surface will engage the downwardly facing angulated surface 19 that extends along one side of the rail 16 and will cause forcible engagement of the angulated surfaces of the mounting base with corresponding angulated surfaces of the rail structure. After sufficient rotation of the locking lever has occurred, the substantially arcuate section 78 of the cam surface will have achieved desired clamping force and the substantially straight locking cam section 76 will move into locking engagement with the corresponding angulated rail surface 19. Since the spacing of the locking cam section 76 from the axis 80 is slightly less than the maximum spacing of the curved cam surface from the axis 80 the force required for rotational locking movement of the locking lever 56 will decrease slightly when the locking position of the locking lever has been reached. This essentially over-center cam movement feature during locking movement causes the locking lever to remain at its locked position once the locking position has been achieved. When rotating the locking lever 56 from its locking position to its unlocked position the opposite over-center force transition occurs. During initial unlocking rotation of the cam plate 72 the curved cam surface section, being located eccentrically with respect to the axis of the spline/pivot shaft 80, will cause slight tightening of the clamping force. During further unlocking rotation of the cam plate the curved cam surface section will move clear of the angulated rail surface 19, thus releasing the clamping force completely. This feature ensures that the locking mechanism of the mount system remains either locked or unlocked unless manual force is applied to the locking lever by the user. This force enhancing rotary locking movement of the locking lever and the resistance of the locking lever 56 to be rotated to its unlocking position causes the locking lever to remain at its locked position and effectively prevents inadvertent unlocking movement of the locking lever 56 even during conditions of rough firearm handling in field conditions.

The desired cam-induced clamping force of the mounting ring assembly is achieved by rotation of the locking lever to its locked position and by controlled positioning of the locking nut 60 on the threaded portion of the pivot shaft 54. The desired clamping force is typically achieved by controlled rotation of the locking nut 60 after the wave spring or other resilient member has been substantially fully compressed or bottomed-out by downward movement of the drive washer member 68 responsive to adjustment rotation of the adjustment nut 60. However, from a practical standpoint the user of the firearm will simply adjust the position of the adjustment nut to ensure positive clamping of the mount rings to the rail, without requiring excessive manual force for locking or unlocking movement of the locking lever 56.

As mentioned above, one of the requirements for effective use of the releasable and adjustable sighting device ring mounts of the present invention by military and police personnel is the requirement that the mounting system be of light weight for ease of firearm handling and yet have sufficient structural integrity to minimize the potential for optics misalignment (loss of zero) by the repeated heavy impacts and vibration of weapon firing or by rough handling in field conditions. To accomplish these features the basic structure of the mounting base and optics mounting rings is composed of a lightweight metal such as aluminum alloy, or a suitable non-metal material. Inserts of hardened material such as stainless steel are located within openings of the base material either by press-fit or by molding them in place. These hard metal inserts are typically internally threaded to receive fastening screws and positioning screws and thus readily accommodate the severe impacts of repeated rifle firing. The inserts protect the mounting base structure and the mounting ring structure from being deformed, and thus minimize the potential for loss of aiming zero as the result of the multiple impacts that occur during repeated rifle firing. As mentioned above, the annular insert 48 shown in FIGS. 6, 7 and 8 is composed of any suitable wear and impact resistant material such as steel, stainless steel or a suitable hard polymer material. The upwardly projecting member or boss 22 is provided with a threaded insert 82 as shown in FIGS. 7 and 12 within which a set screw such as an Allen or Torx screw is received to establish retention of the mounting ring tongues 26 and 28. The threaded inserts are preferably provided with annular flanges 83 which seat against soft metal shoulders or other structure and prevent the inserts from being extracted from their openings or receptacles by tightening of the retainer screws. A threaded hard metal insert 84 is located within the mounting ring tongue 28 and receives a mounting screw, which extends into screw receptacle 86 for retention of the mounting ring tongues in assembly within the circular receptacle 86. Another threaded insert 88 is located within one of the ring assembly sections 30 and receives a retainer screw having a screw head that is located within a screw receptacle 90.

Figure 9:
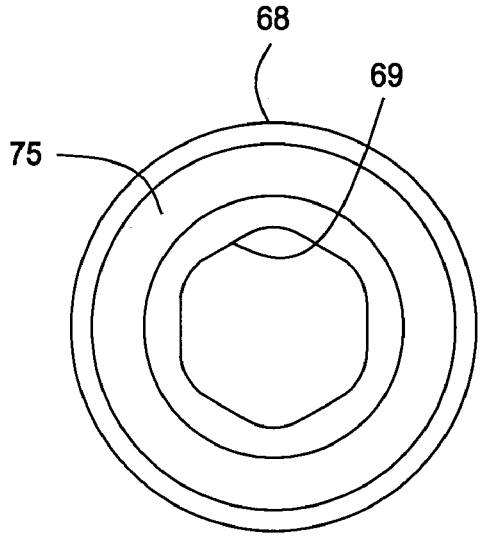
Figure 10:
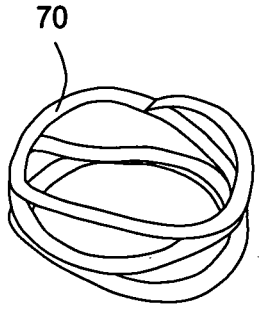
Figure 11:
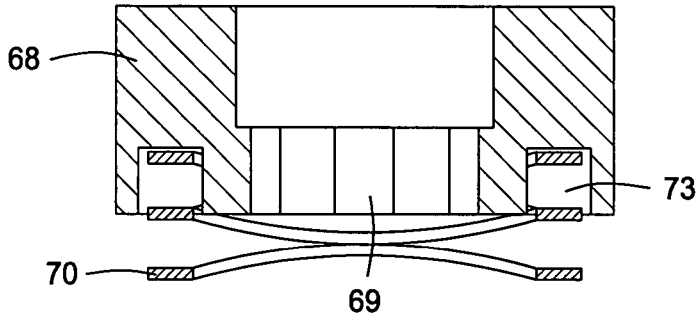

A locator key element 92, shown in the bottom view of FIG. 9, is composed of hard wear and impact resistant material is secured to a bottom surface 94 of the mounting base 22 by retainer screws 96 and 98. The locator key element 92 engages within a selected one of the multiple transverse slots 17 of a mounting rail structure to locate the rear portion of optical sighting device for desired eye relief, which is accomplished by positioning the rear lens of the optical sight device at a selected distance from the eye of the user.

During assembly of the lever mechanism, the adjustment nut 60 is tightened sufficiently to apply a desired force to the wave spring 70. Thereafter, the preload force of the wave spring urges the locking lever upwardly and develops a friction force that prevents the locking from flopping back and forth when it is unlocked. For precision locking and clamping of the mounting base with respect to the angulated locking or clamping surfaces of the rail 16, the adjustment nut 60 is rotated to a desired position on the threaded spindle/spline shaft 54 and thus maintains the angulated cam surface 76 in secure forcible clamping engagement with the angulated locking surface 19 of the mounting rail 16. The splined engagement of the non-circular shaft section 62 and the internal non-circular section 69 of the drive washer member 68 causes the drive washer member to be rotated along with the spindle/spline shaft 54. This feature also causes the adjustment nut 60 of be substantially free of any rotational force that might otherwise tend to loosen or tighten the adjustment nut when the locking lever 56 is rotated. The adjustment nut 60 simply rotates along with the spindle or pivot shaft 54 of the cam plate 72 and the drive washer member 68 during manually energized rotation of the locking lever 56. The force of the wave spring 70 also retards inadvertent movement of the locking lever at its unlocked position. In the event that the mount locking system should become loosened by repeated heavy impact firing of the weapon or for any other reason the mounting system can be easily restored to its optimum stable precision positioning characteristics simply by rotating the adjustment nut only by a few degrees of clockwise rotation by using a small hex wrench. This can be easily accomplished in field conditions since no special adjustment tools are required. For example, from 5 degrees to 15 degrees of adjustment nut rotation will restore the locking mount to its proper locking position for support of an optical sighting device such as a rifle telescope.

An alternative embodiment of the present invention is shown in FIG. 12 and is different from that shown in FIG. 7 only in that one or more resilient O-rings 99 are shown to be located within the annular space 66 and are compressed to the extent desired by the adjustment nut 60 and the washer member 68. The resilient O-ring 99 provides rotational resistance to the locking lever and thus prevents the rotatable locking lever 56 from being loose at its unlocked position, and thus prevents the locking lever from inadvertently moving about. This feature is particularly important when the quick-release mounting system is employed for mounting sighting devices to tactical firearms, where unnecessary lever movement or noise is a detriment to optimum use of the firearm. While one O-ring is shown in FIG. 12, it is to be understood that two or more O-rings may be employed to accomplish the same purpose.

Referring now to FIGS. 16-24, a mounting assembly is shown generally at 100 and represents the preferred embodiment of the present invention. However, it is to be borne in mind that many of the features of the mounting assembly of FIGS. 1-12 are incorporated within the mounting assembly of FIGS. 16-24. The mounting assembly 100 incorporates a mounting base 102 having a downwardly facing mounting slot 104 which is defined by a downwardly facing surface 106 and by a downwardly extending base flange 108 having oppositely angulated rail clamping surfaces 110 and 112. Opposite from the downwardly extending base flange 108 the mounting base 102 defines another downwardly extending base flange 114 having formed thereon an angulated clamping surface 116. Typically, the downwardly facing mounting slot 104 is formed by a machining operation, such as by milling the slot in a metal mounting base workpiece.

A ring mounting member or pedestal 118 projects upwardly from the mounting base 102 and may be integral with the mounting base or fixed to it in any suitable manner. The joint of the pedestal 118 with the mounting base may be strengthened by structural web members 120 and 122 if desired, especially since it is desired that the mount assembly be as light weight as possible while maintaining sufficient structural integrity to ensure secure support of a firearm sighting device. The ring mounting member or pedestal 118, as shown best in FIGS. 20 and 21, defines opposed substantially co-planar ring support shoulders 124 and 126, with a mounting projection 128 extending upwardly from the pedestal and between the ring support shoulders. To minimize the weight of the support pedestal and the mounting base 102, as shown in FIGS. 20 and 21 the mounting base and support pedestal are drilled to remove metal and thus define drill openings 123. As is evident from the bottom view of FIG. 19, some of these metal removing drilled openings 123 extend upwardly into the central mounting projection 128. None of the metal removing drilled openings extend completely through the base or mounting pedestal structures, though it is within the spirit and scope of the present invention to do so. The mounting projection 128 defines spaced transverse bores 130 and 132 as shown in FIGS. 20 and 23 that receive tubular internally threaded ring locator and connector members 134. The internally threaded ring locator and connector members extend from an form part of locator and connector inserts 136 that are received, such as by press fitting within openings 138 of a mounting ring section 139. The inserts 136 are preferably composed of hard metal such as steel, stainless steel, titanium and the like, and are seated on internal support shoulders 140 of the openings 138 of the respective mounting ring section. Mounting screws 142, such as Torx screws, Allen screws or the like, are inserted through openings 144 of the opposite mounting ring section 146. Preferably, each mounting ring section 139 and 146 is provided with an insert having a tubular internally threaded ring locator and connector member to facilitate ease of assembly of the mounting ring sections to the upwardly extending mounting projection 128 and to ensure precise location of the mounting sections with respect to the mounting base 102 and the ring mounting pedestal. The mounting ring sections preferably define annular internal shoulder surfaces 145 thus enabling the heads of the retainer screws 142 to draw the lower portions of the mounting ring sections into tight engagement with respective sides of the central mounting projection 128.

The mounting ring sections 130 and 146 define respective internal arcuate surfaces 148 and 150 that are accurately dimensioned to establish frictional retention with respect to a tubular section of an optical sighting device or any other at least partially cylindrical surface of an object that is to be supported in immoveable relation with respect to a firearm or other object to which a mounting rail is fixed. The upper planar surface 129 of the central mounting projection 128 is located below an imaginary arcuate surface that is defined by continuation of the arcuate surfaces 148 and 150, thus ensuring that the optical device does not engage the central mounting projection 128 of the pedestal 118. This feature ensures that the cylindrical tube or portion of the optical sighting device remains free of torque forces when the mounting ring sections 139 and 146 are tightened to the central mounting projection 128.

As shown in detail in FIG. 24, for securing the upper portions of the mounting ring sections in assembly, internally threaded hardened inserts 152 are press fitted or otherwise located within openings 154 of the respective mounting ring sections 139 and 146. Preferably the internally threaded hardened inserts 152 are seated on annular internal shoulders 156 of the mounting ring sections to ensure that the inserts are not moved within the openings 154 by the force that is generated by tightening of the retainer screws. The externally threaded sections 158 of retainer screws 160 are threaded into the inserts and serve to secure the mounting ring sections 139 and 146 in friction retention with an optical sighting device or other object. The respective mounting ring sections 139 and 146 define retainer openings 162 and annular internal support shoulders 164 that are engaged by the heads of the retainer screws 160 and thus enable the retainer screws to tighten the upper portions of the mounting ring sections 139 and 146 together and establish fictional retention of the tubular section of the optical sighting device or other object being supported.

At least two spaced positioning projections 166 and 168 extend downwardly from the central portion of the mounting base 102, as shown in FIGS. 18 and 19, with the space therebetween being sufficient to receive one of the upwardly extending mounting projections 15. A locking platform 170 projects laterally from the mounting base structure 102 and is preferably formed integrally with the mounting base though it may be fixed to the mounting base in any suitable fashion. The support platform is machined in the same manner as is discussed above in connection with the locking platform 44 of FIGS. 1-6 to form a mounting receptacle for a locking lever mounting assembly which is indicated by like reference numerals and is provided for the same purpose.

Situations will arise requiring only a single releasable mounting device or requiring more than two spaced releasable mounting devices for mounting optical sighting devices and other objects to firearms. Thus, it is not intended that the present invention be restricted solely to the use of two spaced quick-release mounting devices for mounting firearm optical devices. It is also intended that the present invention have application to a wide range of devices that are intended to be mounted in quick-release, stable fashion to a support structure. Thus, it is not intended to restrict the spirit and scope of the present invention to use in connection with the sighting devices of firearms. The discussion here, for purposes of simplicity, is intended only to be representative of a preferred embodiments of the present invention. Other and further embodiments of the present invention will become obvious and inherent to one skilled in the art upon a thorough understanding of the spirit and scope of the present invention.

In view of the foregoing it is evident that the present invention is one well adapted to attain all of the objects and features hereinabove set forth, together with other objects and features which are inherent in the apparatus disclosed herein.

As will be readily apparent to those skilled in the art, the present invention may easily be produced in other specific forms without departing from its spirit or essential characteristics. The present embodiment is, therefore, to be considered as merely illustrative and not restrictive, the scope of the invention being indicated by the claims rather than the foregoing description, and all changes which come within the meaning and range of equivalence of the claims are therefore intended to be embraced therein.

I claim:

1. An adjustable mounting system, comprising:

a mounting rail attached to a structure and defining a plurality of upwardly facing mounting projections each having oppositely angulated clamping surfaces;

at least one mounting base having an angulated clamp surface and defining a locking platform having a lock opening therein;

a locking lever having a rotary cam plate and a pivot shaft integral therewith, said pivot shaft being rotatable within said lock opening, said rotary cam plate having a peripheral angulated cam surface being moveable into force transmitting locking engagement with one of said oppositely angulated clamp surfaces upon rotation of said locking lever and cam plate from an unlocking position to a locking position; and an adjustment nut being threaded to said pivot shaft and upon rotation on said pivot shaft adjusting the locking position of said rotary cam plate relative to one of said oppositely angulated clamp surfaces.

2. The adjustable mounting system of claim 1, comprising:

a drive member being received for linear movement on said pivot shaft; and at least one resilient member being interposed between said drive member and said locking platform and providing resistance to free rotation of said locking lever at the unlocked position of said locking lever.

3. The adjustable mounting system of claim 1, comprising:

said pivot shaft defining a threaded section receiving said adjustment nut and defining an external non-circular section;

a drive member having non-rotatable and linearly moveable relation with said external non-circular section; and said adjustment nut having adjustment engagement with said drive member.

4. The adjustable mounting system of claim 3, comprising:

said at least one resilient member being interposed between said drive member and said locking platform and preventing free rotational movement of said locking lever at said unlocking position.

5. The adjustable mounting system of claim 1, comprising:

said pivot shaft defining a threaded section receiving said adjustment nut and having an external non-circular section;

a drive member being received in non-rotatable and linearly moveable relation by said external non-circular section;

said at least one resilient member being interposed between said drive member and said locking platform and developing a spring force retarding free rotation of said locking lever at the unlocking position thereof; and said adjustment nut being received by said pivot shaft and being rotatable for adjustment of the locking position of said cam plate.

6. The adjustable mounting system of claim 5, comprising:

said at least one resilient member being an annular wave spring.

7. The adjustable mounting system of claim 5, comprising:

said at least one resilient member being at least one O-ring composed of resilient material.

8. The adjustable mounting system of claim 1, comprising:

one of said oppositely angulated clamping surfaces having a predetermined angle;

said rotary cam plate defining first and second substantially straight cam surfaces being joined by a curved cam surface; and said first and second substantially straight cam surfaces and said curved cam surface each having a taper substantially corresponding to said predetermined angle.

9. The adjustable mounting system of claim 1, comprising:

said mounting rail defining spaced positioning receptacles and spaced upwardly extending mounting projections; and said mounting base having at least one locator key having engagement within one of said spaced positioning receptacles and selectively locating said mounting base on said mounting rail.

10. The adjustable mounting system of claim 9, comprising:

said mounting base having a pair of downwardly projecting locator keys disposed in spaced relation and having locating engagement within two of said spaced positioning receptacles.

11. The adjustable mounting system of claim 1, comprising:

said mounting base defining a ring mounting receptacle;

a pair of mounting ring sections each defining arcuate internal surface sections and each having a mounting tongue being received within said ring mounting receptacle; and retainer members securing said mounting tongues in fixed relation within said ring mounting receptacles and being selectively adjustable to position said arcuate internal surface sections in frictional retention with a supported device.

12. The adjustable mounting system of claim 11, comprising:

a plurality of connector receptacles being located within said mounting ring sections;

a plurality of hardened inserts being fixed within said plurality of connector receptacles and defining internally threaded connector sections; and a plurality of retainer screws being in threaded connection within said internally threaded connector sections and retaining said mounting ring sections in friction supported engagement with a supported object.

13. The adjustable mounting system of claim 12, comprising:

said plurality of connector receptacles each defining internal insert support shoulders; and said plurality of hardened inserts being seated on and supported by said internal insert support shoulders.

14. The adjustable mounting system of claim 1, comprising:

said mounting base having a mounting pedestal defining an upwardly extending mounting projection having transverse mounting openings therein, said mounting pedestal defining mounting ring support shoulders;

a pair of mounting ring sections being seated on said mounting ring support shoulders and defining internal arcuate surfaces for frictional retaining engagement with a supported device; and retainer members extending through said mounting ring sections and through said transverse mounting openings of said upwardly extending mounting projection and retaining said mounting ring sections in immoveable assembly with said support pedestal.

15. The adjustable mounting system of claim 14, comprising:

said upwardly extending mounting projection defining at least one transverse bore extending therethrough;

at least one of said mounting ring sections having a hardened insert therein defining an internally threaded ring locator member projecting into said at least one transverse bore;

another of said mounting ring sections defining at least one mounting screw opening having an internal shoulder surface; and a mounting screw being located within said mounting screw opening and being seated on said internal shoulder surface, said mounting screw having a threaded section having threaded engagement with said internally threaded ring locator member and securing said mounting ring sections in supported assembly with said upwardly extending mounting projection of said support pedestal.

16. An adjustable mounting system, comprising:

a mounting rail attached to a structure and defining a plurality of upwardly facing mounting projections each having oppositely angulated clamping surfaces;

at least one mounting base having an angulated clamp surface and defining a locking platform having a lock opening therein;

a locking lever having a rotary cam plate and a pivot shaft integral therewith and being rotatably moveable between locking and unlocking positions, said pivot shaft being rotatable within said lock opening, said rotary cam plate having a peripheral angulated cam surface being moveable into force transmitting locking engagement with one of said oppositely angulated clamp surfaces upon rotation of said locking lever and cam plate from an unlocking position to a locking position;

a drive member being received in non-rotatable linearly moveable relation on said pivot shaft;

an adjustment nut being threaded to said pivot shaft and providing for adjustment of the locking position of said rotary cam plate relative to one of said oppositely angulated clamp surfaces; and at least one resilient member being interposed between said drive member and said locking platform and providing resistance to free rotation of said locking lever at the unlocked position of said locking lever.

17. The adjustable mounting system of claim 16, comprising:

an annular insert being seated within said lock opening and defining a circular pocket;

said drive member being at least partially located within said circular pocket; and said at least one resilient member being located within said circular pocket and being engaged by said drive member and providing resistance preventing free rotation of said locking lever.

18. The adjustable mounting system of claim 16, comprising:

said peripheral angulated cam surface of said rotary cam plate having a pair of substantially straight cam sections disposed in angular relation and having a curved cam section merging with said substantially straight cam sections.

19. The adjustable mounting system of claim 16, comprising:

said pivot shaft defining a threaded section receiving said adjustment nut and having an external non-circular section;

a drive member being received in non-rotatable and linearly moveable relation by said external non-circular section;

said at least one resilient member being interposed between said drive member and said locking platform and developing a spring force retarding free rotation of said locking lever at the unlocking position thereof; and said adjustment nut being received by said pivot shaft and being rotatable for adjustment of the locking position of said cam plate.

20. The adjustable mounting system of claim 16, comprising:

said mounting base having a mounting pedestal defining an upwardly extending mounting projection having transverse mounting openings therein, said mounting pedestal defining mounting ring support shoulders;

a pair of mounting ring sections being seated on said mounting ring support shoulders and defining internal arcuate surfaces for frictional retaining engagement with a supported device; and retainer members extending through said mounting ring sections and through said transverse mounting openings of said upwardly extending mounting projection and retaining said mounting ring sections in immoveable assembly with said support pedestal.

21. The adjustable mounting system of claim 20, comprising:

said upwardly extending mounting projection defining at least one transverse bore extending therethrough;

at least one of said mounting ring sections having a hardened insert therein defining an internally threaded ring locator member projecting into said at least one transverse bore;

another of said mounting ring sections defining at least one mounting screw opening having an internal shoulder surface; and a mounting screw being located within said mounting screw opening and being seated on said internal shoulder surface, said mounting screw having a threaded section having threaded engagement with said internally threaded ring locator member and securing said mounting ring sections in supported assembly with said upwardly extending mounting projection of said support pedestal.

* * * * *

US007272904C1

(12) EX PARTE REEXAMINATION CERTIFICATE (6757th)

United States Patent
Larue

(10) Number: US 7,272,904 C1
(45) Certificate Issued: Apr. 7, 2009

(54) ADJUSTABLE THROW-LEVER PICATINNY RAIL CLAMP

(76) Inventor: Mark C. Larue, 850 County Rd. 177, Leander, TX (US) 78641

Reexamination Request:
No. 90/010,041, Oct. 29, 2007

Reexamination Certificate for:

| | |
|---|---|
| Patent No.: | **7,272,904** |
| Issued: | **Sep. 25, 2007** |
| Appl. No.: | **11/008,394** |
| Filed: | **Dec. 9, 2004** |

(51) Int. Cl.
*F41G 1/38* (2006.01)

(52) U.S. Cl. ..... 42/127; 42/124; 42/125; 292/145; 292/155; 292/176; 292/43

(58) Field of Classification Search ..... 42/124–128
See application file for complete search history.

(56) References Cited

U.S. PATENT DOCUMENTS

| | | | | | |
|---|---|---|---|---|---|
| 4,531,321 | A | * | 7/1985 | Bechtel | 42/126 |
| 4,845,871 | A | * | 7/1989 | Swan | 42/127 |
| 5,276,988 | A | * | 1/1994 | Swan | 42/127 |
| 6,026,580 | A | * | 2/2000 | LaRue | 42/127 |

OTHER PUBLICATIONS

Technical Manual, TM 9–4931–710–14&P, dated Aug. 1986, Department of the Army.*

* cited by examiner

*Primary Examiner*—Matthew C. Graham

(57) ABSTRACT

A throw-lever releasable mounting system for mounting a device in quick-release relation to a support member has a mounting base having a configuration fitting opposed angulated rail surfaces and having a locator key engaging a positioning slot of the rail. Each mounting base provides for mounting and stabilization of optics mounting rings. A locking platform projects from the mounting base and defines a locking opening having a circular hard metal insert therein that defines a receptacle receiving a resilient member and providing for location of the spline/spindle shaft of a rotatable locking plate. A locking plate of a throw-lever that is rotatable between locking and unlocking positions has angulated and curved cam surfaces for forcibly engaging correspondingly angulated surfaces of the rail to achieve cam energized precision locating and locking engagement with the rail. A non-circular section of a spline/spindle shaft of the throw-lever is receives a drive member in non-rotatable and linearly moveable relation. Resilient members are interposed between the drive member and the hardened insert and prevent free throw-lever movement at the release position thereof.

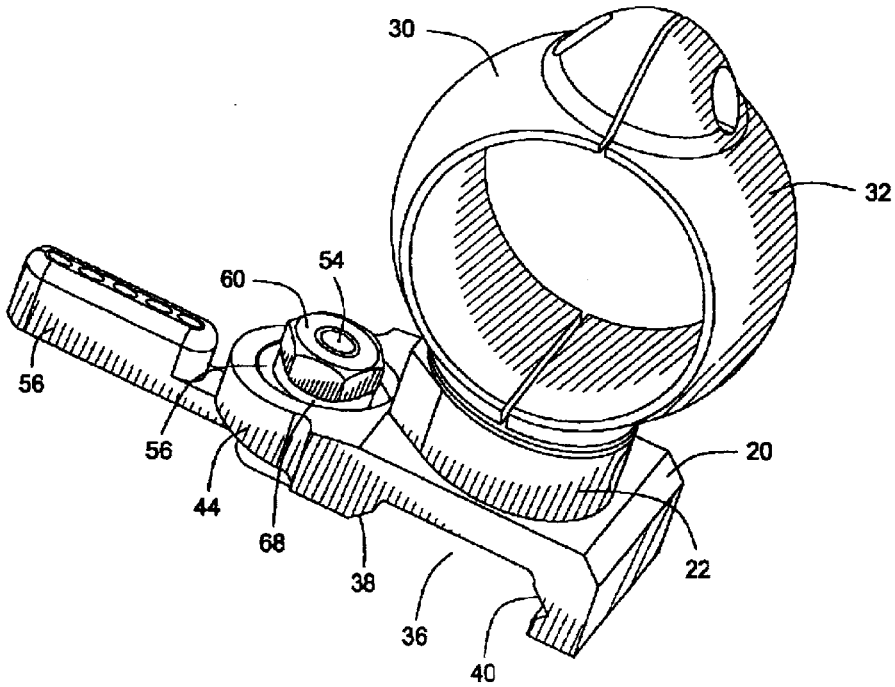

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 2 and 19 are cancelled.

Claims 1, 3, 4, 5 and 16 are determined to be patentable as amended.

Claims 6–15, 17–18 and 20–21, dependent on an amended claim, are determined to be patentable.

New claim 22 is added and determined to be patentable.

1. An adjustable mounting system, comprising:

a mounting rail attached to a structure and defining a plurality of upwardly facing mounting projections each having oppositely angulated clamping surfaces;

at least one mounting base having an angulated clamp surface and defining a locking platform having a lock opening therein;

a locking lever having a *one-piece unitary* rotary cam plate and [a] pivot shaft integral therewith, said pivot shaft being rotatable within said lock opening, said rotary cam plate having a peripheral angulated cam surface being moveable into force transmitting locking engagement with one of said oppositely angulated clamp surfaces upon rotation of said locking lever and *one-piece unitary rotary* cam plate *and pivot shaft* from an unlocking position to a locking position; [and]

an adjustment nut being threaded to said pivot shaft and upon rotation on said pivot shaft adjusting the locking position of said *one-piece unitary* rotary cam plate *and pivot shaft* relative to one of said oppositely angulated clamp surfaces*;*

*a drive member engaging said adjustment nut and having a central opening receiving said pivot shaft, said drive member having non-rotatable and linearly moveable relation with said one-piece unitary rotary cam plate and pivot shaft; and*

*a resilient member having force transmitting relation with said drive member and continuously urging said drive member against said adjustment nut and developing friction for resisting inadvertent rotation of said adjustment nut on said pivot shaft relative to said drive member during locking and unlocking rotation of said locking lever.*

3. The adjustable mounting system of claim 1, comprising:

said pivot shaft defining a threaded section receiving said adjustment nut and defining an external non-circular section;

[a] *said central opening of said* drive member *being of non-circular configuration and establishing said* [having] non-rotatable and linearly moveable relation with said external non-circular section *of said pivot shaft*; and

*adjustment rotation of* said adjustment nut [having] *on said threaded section of said pivot shaft causing linear* adjustment [engagement with] *movement of* said drive member *on said pivot shaft and linear adjustment of said one-piece unitary rotary cam plate and pivot shaft relative to said angulated clamping surfaces of said mounting rail.*

4. The adjustable mounting system of claim 3, comprising:

said at least one resilient member being interposed between said drive member and said locking platform and *imparting force to said drive member and force and frictional resistance to said locking lever* preventing free rotational movement of said locking lever at said unlocking position.

5. The adjustable mounting system of claim 1, comprising:

said pivot shaft defining a threaded section receiving said adjustment nut and having an external non-circular section;

[a] *said central opening of said* drive member being *of non-circular configuration and being* received in non-rotatable and linearly moveable relation by said external non-circular section *of said pivot shaft*;

said at least one resilient member being interposed between said drive member and said locking platform and developing a spring force *developing frictional resistance* retarding free rotation of said locking lever at the unlocking position thereof; and said adjustment nut being received by said *threaded section of said* pivot shaft and being rotatable for adjustment of the locking position of said cam plate *relative to said clamping surfaces of said mounting rail.*

16. An adjustable mounting system, comprising:

a mounting rail attached to a structure and defining a plurality of upwardly facing mounting projections each having oppositely angulated clamping surfaces;

at least one mounting base having an angulated clamp surface and defining a locking platform having a lock opening therein;

a locking lever having a *one-piece unitary pivot shaft and* rotary cam plate [and a pivot shaft] integral therewith and being rotatably moveable between locking and unlocking positions, said pivot shaft being rotatable within said lock opening *and having a non-circular section*, said rotary cam plate having a peripheral angulated cam surface being moveable into force transmitting locking engagement with one of said oppositely angulated clamp surfaces upon rotation of said locking lever and *said one-piece unitary pivot shaft and rotary* cam plate from [an] *said* unlocking position to [a] *said* locking position;

a drive member *having an internal non-circular drive opening* being received in non-rotatable *and* linearly moveable relation on said *non-circular section of said* pivot shaft;

an adjustment nut being threaded to said pivot shaft and *having engagement with said drive member and* providing for adjustment of the locking position of said *one-piece unitary pivot shaft and* rotary cam plate relative to one of said oppositely angulated clamp surfaces; and at least one resilient member being interposed between said drive member and said locking platform and *having force transmitting relation with said drive member urging said drive member into frictional engagement with said adjustment nut ensuring concurrent rotation of said pivot shaft said drive member and said adjustment nut during locking and unlocking rotation of said locking lever, preventing inadvertent rotation of said adjustment nut on said pivot shaft and* providing resistance to free rotation of said locking lever at the unlocked position of said locking lever.

*22. An adjustable mounting system, comprising:*

*a mounting rail attached to a structure and defining a plurality of upwardly facing mounting projections each having an angulated clamping surface;*

*a least one mounting base having an angulated clamp surface and defining a locking platform having a lock opening therein;*

*a locking lever having a one-piece unitary pivot shaft and rotary cam plate, said pivot shaft having a threaded end and a non-circular section and being rotatable within said lock opening, said rotary cam plate having an angulated locking surface being moveable into force transmitting locking engagement with said angulated clamp surface upon rotation of said one piece unitary locking lever from an unlocking position to a locking position;*

*an adjustment nut being threaded to said threaded end of said pivot shaft and upon rotation on said pivot shaft adjusting the locking position of said rotary cam plate relative to said angulated clamp surface;*

*a drive member having a central opening of non-circular configuration receiving said non-circular section of said pivot shaft and having non-rotatable and linearly moveable relation with said pivot shaft, said drive member rotating concurrently with said pivot shaft during unlocking and locking rotation of said locking lever, said drive member having non-rotatable force transmitting engagement with said adjustment nut preventing inadvertent rotation of said adjustment nut upon locking and unlocking rotation of said locking lever and being moveable linearly by rotational adjustment of said adjustment nut; and*

*a resilient member having force transmitting relation with said drive member and urging said drive member against said adjustment nut.*

* * * * *